United States Patent [19]

Kuplas

[11] 4,452,618

[45] Jun. 5, 1984

[54] SUCTION CLEANERS WITH A BAG TRANSFER ARRANGEMENT

[75] Inventor: Harbey Kuplas, North Wembley, England

[73] Assignee: The Hoover Company, North Canton, Ohio

[21] Appl. No.: 374,161

[22] Filed: May 3, 1982

[30] Foreign Application Priority Data

May 7, 1981 [GB] United Kingdom ..... 8113955
Dec. 10, 1981 [GB] United Kingdom ..... 8137344

[51] Int. Cl.[3] ..... B01D 46/02; B01D 46/42

[52] U.S. Cl. ..... 55/362; 15/323; 15/347; 55/373; 55/376; 55/378; 55/422; 55/472; 55/473; 55/493; 55/DIG. 2; 55/DIG. 3

[58] Field of Search ..... 55/362, 373, 376, 374, 55/378, 422, 472, 493, DIG. 2, DIG. 3, 473; 15/323, 347

[56] References Cited

U.S. PATENT DOCUMENTS 2,534,280 12/1950 Lofgren ..... 55/362
2,646,855 7/1953 Senne ..... 55/373 X
2,734,595 2/1956 Hurd ..... 55/373 X
3,132,932 5/1964 Pauler et al. ..... 55/376

FOREIGN PATENT DOCUMENTS 210133 10/1956 Australia ..... 55/373
1628703 7/1971 Fed. Rep. of Germany ..... 55/373

*Primary Examiner*—Kathleen J. Prunner
*Attorney, Agent, or Firm*—Gerald H. Kreske; Richardson B. Farley

[57] ABSTRACT

A suction cleaner having a motor fan unit and a casing having a dirt bag receiving compartment closed by a bag carrier in the form of a door and having a bag mount therein in the form of an air conduit extending from the motor fan unit. A dirt collecting bag can be disposed on each of the bag carrier and the bag mount. The bag carrier and the bag mount are relatively movable towards one another to automatically cause a latching assembly to secure a bag on the bag mount, with an opening of the bag in sealing engagement with the air conduit. The bag mount is movable between a bag unloading position away from said casing, and an operative position in which the bag is carried by the bag mount away from the bag carrier.

8 Claims, 19 Drawing Figures

SUCTION CLEANERS WITH A BAG TRANSFER ARRANGEMENT

BACKGROUND OF THE INVENTION

1. Field of the Invention

The invention is directed to dirt bag removal and, more specifically, directed to a mechanism in a floor care appliance which aids in the insertion and removal of dirt collecting bags.

2. Summary of the Prior Art

This invention relates to suction cleaners of the type which incorporate a disposable dirt bag usually made of porous paper. Many suction cleaners of this type have been manufactured, and proposed but not manufactured, in which the paper bags are manually inserted and removed from a cleaner casing. Generally speaking this involves awkward manual manipulation of the bag both during removal and insertion, and the user finds it difficult to keep his or her hands clean during this operation.

U.S. Pat. No. 2,646,855 (Senne) proposes a filter replacement mechanism for a vacuum cleaner in which a filled bag is manually removed from a casing after the casing has automatically moved to an open position. As the operator manually moves the casing back to its closed position the mechanisms therein will automatically release the lowermost of a reserve of fresh filter units and permit one of the units to drop in a swinging motion downward into a position occupied by the previously removed filter bag. This construction does not however provide for automatic securement of a filter bag in an operative position in relation to an air conduit.

German OLS No. 2,139,671 (Siemens) also discloses a construction in which a reserve of filter bags is shown in shown but there is no reference as to how the bags are secured in position in the cleaner in their operative position.

U.S. Pat. No. 2,532,642 (Senne) discloses a complicated mechanism for bag loading and unloading with the bag held in operative position, but this patent does not provide for swinging of the operative parts to provide for bag expansion.

SUMMARY OF THE INVENTION

According to one aspect of the present invention a suction cleaner has a bag carrier and a bag mount which are relatively movable towards one another to cause securing means automatically to secure a bag on the bag mount with an opening of the bag in sealing engagement with an air conduit, whereafter the bag carrier and the bag mount are relatively separable to permit the bag to expand between the bag carrier and the bag mount.

Conveniently, the bag carrier acts as a magazine to receive a plurality of bags. The bag carrier may be movable between an open position with respect to a casing to permit withdrawal of a full bag, and a bag-transfer position in which a bag on the carrier is addressed to the bag mount. The bag mount may be movable between a bag loading/bag unloading position and an operative region to which the bag is carried by the bag mount away from the bag carrier. The bag mount may be connected to the bag carrier so that movements of the bag mount are affected by moving the bag carrier. However, there may be a catch to prevent movement of the bag mount by the bag carrier as far as the bag unloading position if the bag carrier is being moved merely to enable the user to see whether the bag requires changing, the catch being releasable by the user to permit movement of the bag mount to the bag unloading position if desired.

The securing means may comprise latches carried by the bag mount and adapted to engage spaced portions of a stiff bag collar provided on the bag. One such latch may be fixed relative to the bag mount while the other is movable relative to the bag mount and is biased to its latching position by a stationary guide which this latch engages during movement of the bag mount from the bag loading position, and with which the latch remains engaged while the bag mount is in the operative region. This latch may also be resiliently biased towards its latching position and be movable from its latching position to an unlatched position by movement of the bag mount from the operative region to the bag unloading position.

The bag mount preferably has a seal arranged to be compressed by movement of the bag collar when the bag carrier is moved to the bag-transfer position.

The cleaner may be of an upright type in which the bag mount comprises a tube extending upwards within an outer casing, the said air conduit being at the upper end of the tube and the tube being pivotally mounted about a horizontal axis at its lower end. The bag carrier may comprise a door to the outer casing which is pivoted to the remainder of the casing about an axis parallel to and in front of the said horizontal pivotal axis of the bag mount.

DESCRIPTION OF THE DRAWINGS

Reference may now be had to the accompanying drawings for a better understanding of the invention, both to its organization and function, with the illustration being only exemplary, and in which.

Figure 1:
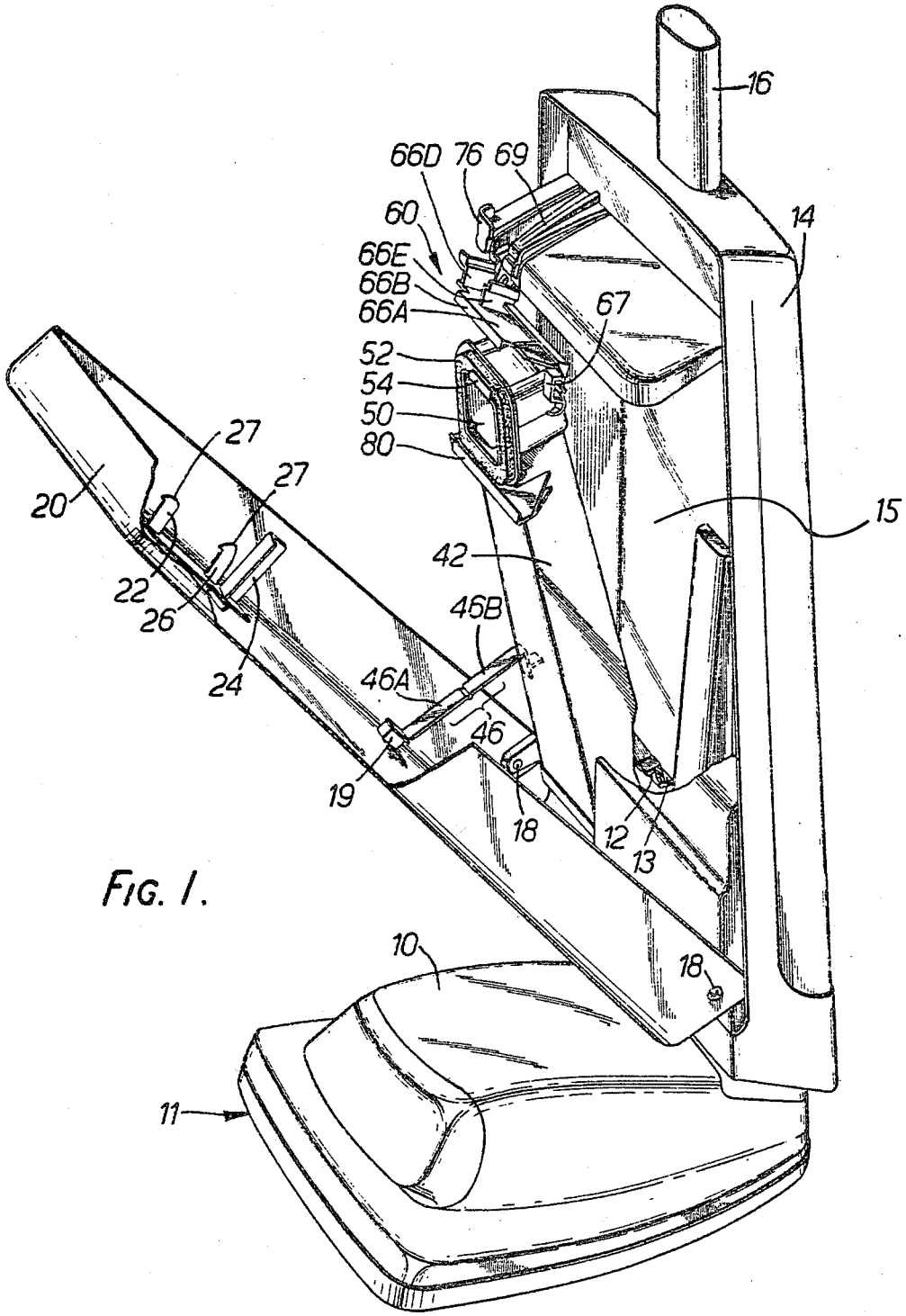
FIG. 1 is a perspective view of a preferred form of an upright suction cleaner with a door in an open position and with certain parts broken away.

Extending upwards from the rear of the lower casing 10 is an upright, generally rectangular, casing 14 forming a cavity 15 serving as a dirt collecting bag receiving cavity or as a dirt bag receiving compartment which is of a rigid nature and which is surmounted by a handle 16. The casing 14 is secured in its upright position of FIG. 1 in a conventional manner by a latch, which can be released by a foot pedal not shown.

The casing 14 has a door 20 pivoted at its lower end about a horizontal axis on pivots 18. The door extends for the full height of the front of the casing 14 and is shown in an open position in FIG. 1. The door also serves as a bag carrier. For this purpose it has two tongues 22 and 26 arranged in the same vertical plane, for mounting a series of five paper bags of the type shown in FIG. 2. Each tongue has a hook-like enlargement 27 at its tip. Each bag comprises a folded and glued paper bag 30 made of conventional material which filters dirt from an air stream which passes through the porous wall of the bag. The bag has a stiff cardboard mounting collar 32 provided with an oblong opening 34 which is in register with a corresponding opening or mouth of the paper bag. One side of the collar projects beyond the side of the paper bag, and in this projecting side the collar has slots 36 and 40 to receive the door tongues 22 and 26, respectively. The vertical length of each slot is only slightly greater than the vertical height of the tongue behind the hook 27, and each slot is partly closed at its lower end by a hook-shaped portion 36A, 40A of the collar. Thus the collar is held against accidental dislodgement from the tongues, but the hook-shaped portions 36A, 40A have sufficient give to enable the slots to be passed over the tip hooks 27 of the tongues when the bags are being placed on the tongues, and when they are being automatically transferred from the tongues to their operative location, as described below. The door 20 acts as a magazine containing five bags with the cardboard collars 32 supported on the hooks 22, 26 and facing rearwards. The closing of the door from the position of FIG. 1 automatically latches the rearmost bag collar onto the bag mount by means of a mechanism contained within the casing 14 in a manner to be described.

In addition to the two bag-supporting tongues 27, the door carries a locating prong 24 for a purpose described later.

The casing 14 has extending upwardly therein an exhaust air fill tube or air conduit 42 of a rigid tubular nature connected at its lower end by a bellows, not shown, to an exhaust opening extending from the outlet of the motor fan unit. At the back of the fill tube 42 near the bottom is a downwardly facing lip 12 which rests on a ledge 13 in the casing 14 to form a pivot having a horizontal axis. This pivotal axis is to the rear of the axis of the pivots 18 of the door 20 so that points on the fill tube 42 and on the door 20 which are equidistant from the respective pivot axes move along different axes. Somewhat above the level of the pivots 18, the door 20 is connected to one side of the fill tube 42 by means of a strap 46. The rear portion of the strap 46 is integral with the fill tube, the whole strap and the fill tube being parts of a one-piece moulding of a suitable plastics material such as polypropylene. The front end portion of the strap is secured to the door 20 at 19, e.g. by a screw. Spaced apart along the length of the strap between the end portions are three living hinges, i.e. transverse strips of reduced thickness, defining two intermediate hinged portions, 46A and 46B.

The fill tube 42 constitutes a bag mount. It extends upwards within the casing 14 and terminates in a forwardly facing outlet 50 which is surrounded by a seal 52 formed of foam plastics. Upstanding from the top forward edge of the opening 50 in front of the upper portion of the seal 52 is a hook 54. The hook 54 is not secured to the seal 52 so that, as will be described, the cardboard collar 32 of a bag can be addressed up against the seal 52 and the seal 52 compressed to the position shown in FIG. 10, at which time the collar 32 of the bag lies in a plane slightly behind the hook 54. The bag and collar achieve this position during the closing movement of the door to the position of FIG. 6.

Moulded integrally with the rear upper end of the fill tube 42 are bag securing means. These means comprise a movable bag latching assembly generally indicated at 60, which includes lateral lugs 62 to which are connected, via living hinges 64, an upper latch member which includes a generally horizontal portion 66A projecting from a rear wall 65, and a downwardly turned latch 66B, together with a rear tab 66C upstanding from the rear wall 65. The member also comprises a pair of vertical webs 66D and 66E shown most clearly in FIG. 3.

Figure 2:
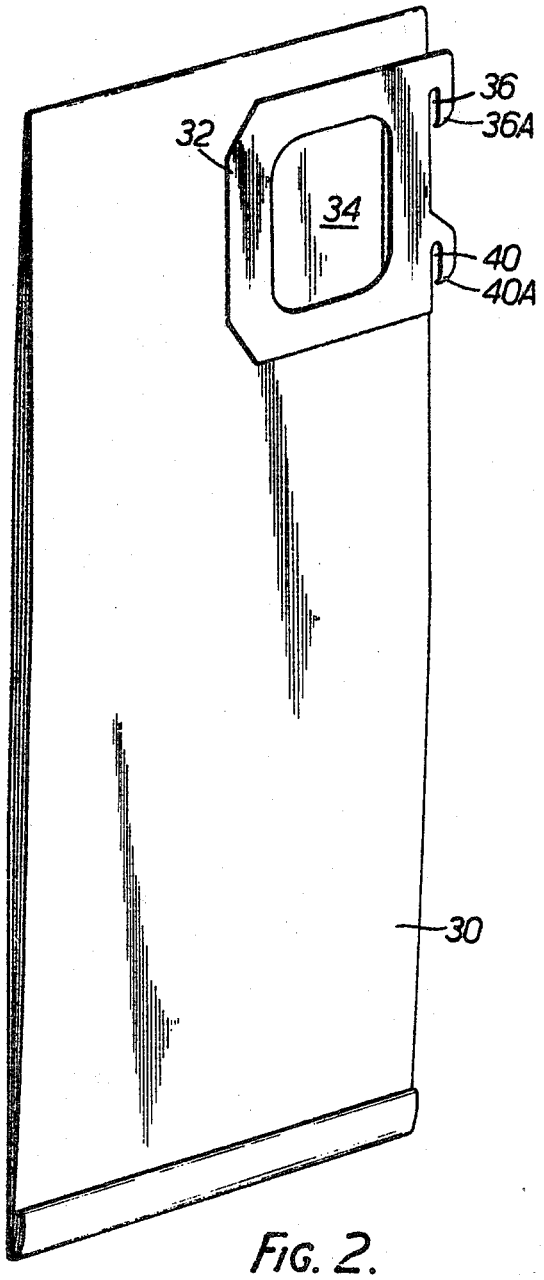
FIG. 2 is a perspective view of a paper bag with a cardboard collar secured thereto which is utilized in the cleaner of FIG. 1.
Figure 8:
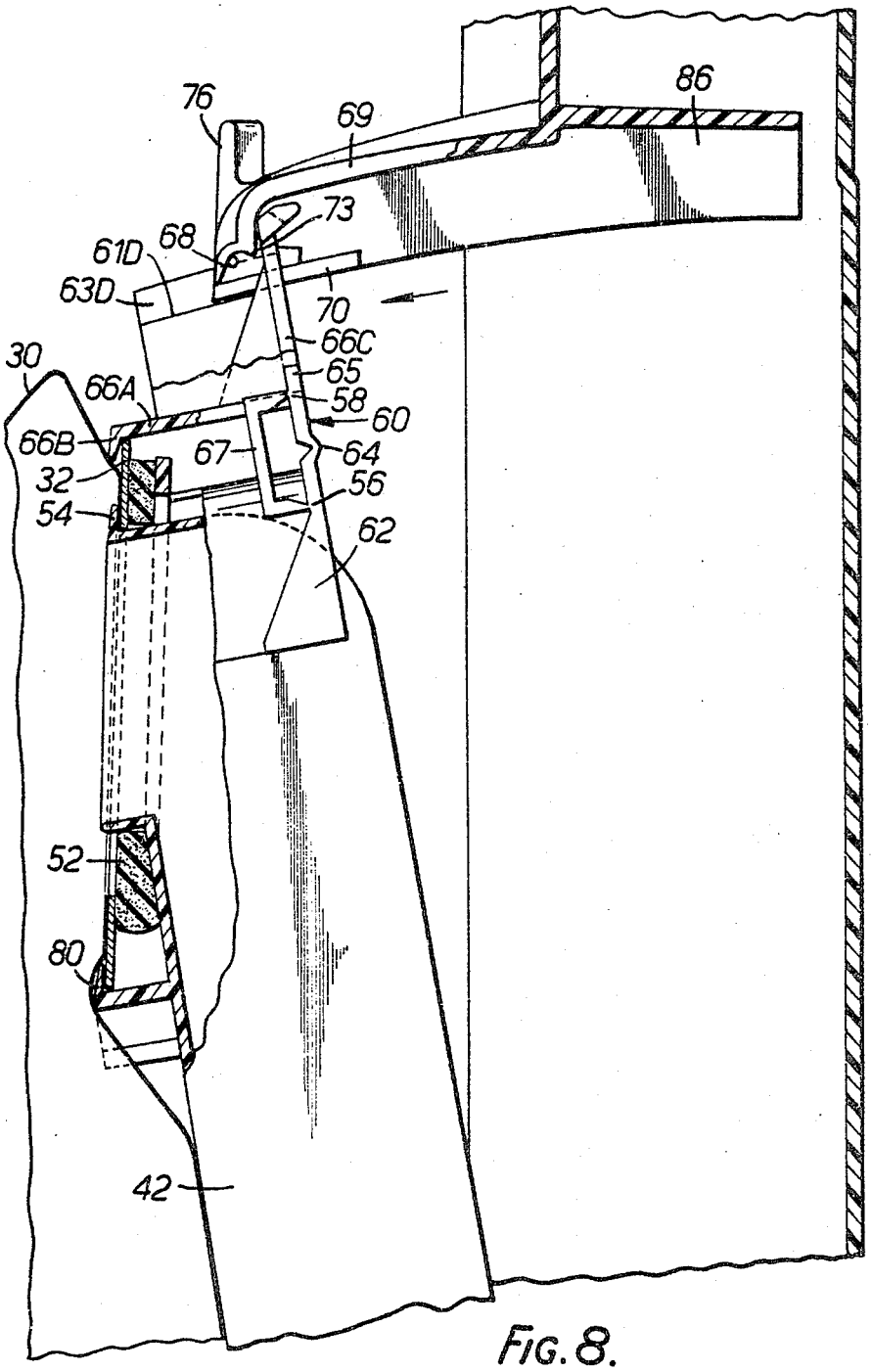
FIG. 8 is a sectional side elevation of the same part showing the bag mount about to reach the bag unloading position.
Figure 9:
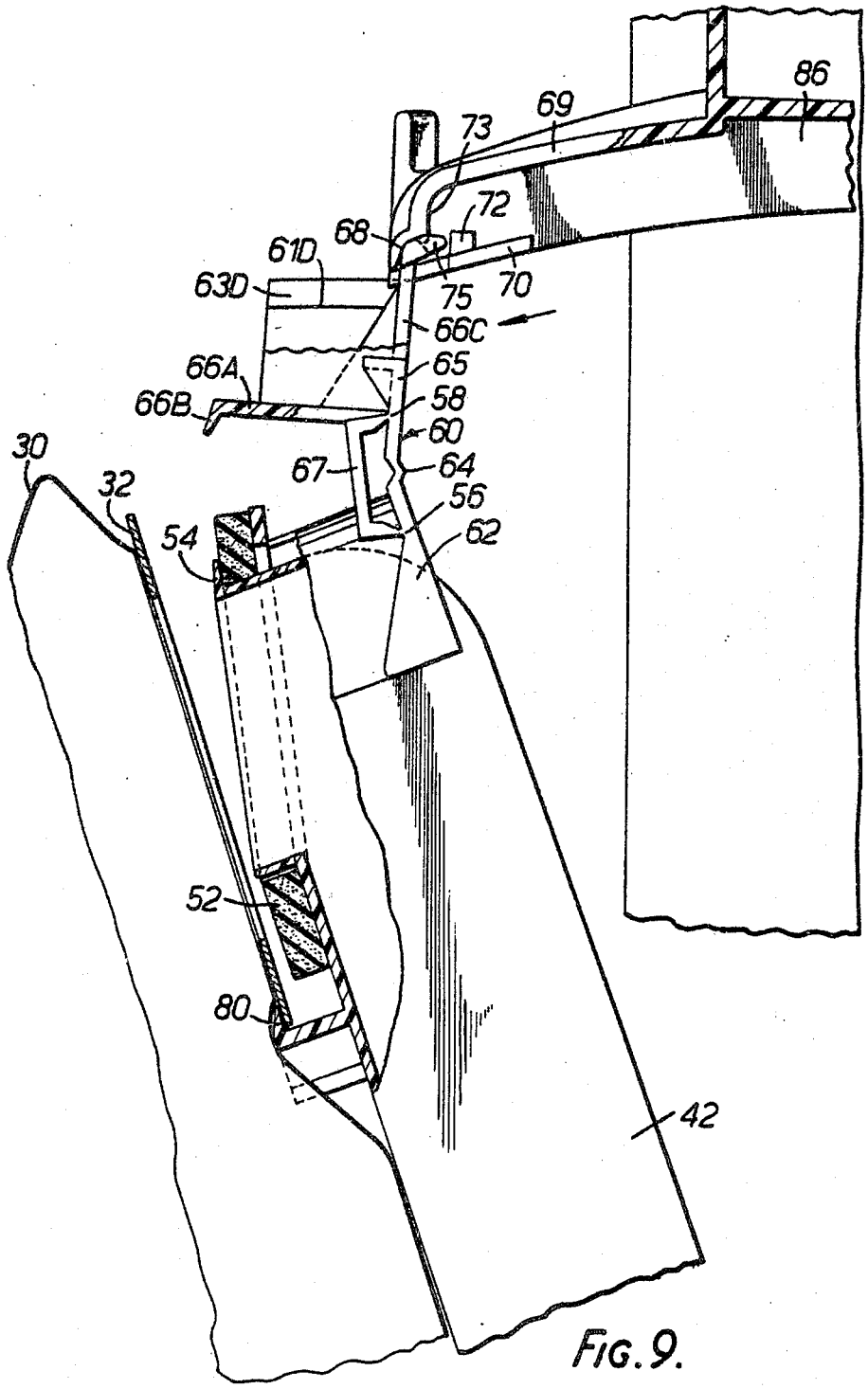
FIG. 9 is a sectional side elevation of the same part in the bag unloading position in which the bag is ready to be removed by hand from the cleaner.

The upper latch member also includes, at each side of the member and bridging the hinge 64, a roughly C-shaped integral spring portion 67. The lower limb of the C is connected to the corresponding lateral lug 62 by a lower living hinge 56, and the upper limb of the C is connected to a rear wall 65 by an upper living hinge 58. When the rear wall 65 is in alignment with the lateral lugs 62, as shown in FIGS. 6, 7, 8 and 10, the spring portion 67 is virtually unstressed. When, however, the rear wall 65 is forced into an inclined position relative to the lateral lugs 62, accompanied by flexure at the living hinges 64, as shown in FIGS. 1 and 9, the locus of movement of the upper living hinge 58 is along an arc struck about the living hinge 64, so the distance between the upper and lower living hinges 56 and 58 is reduced and each C-shaped spring portion 67 is distorted. The reaction to this strain on the spring portions 67 is to apply a restoring force tending to urge the rear wall 65 back into alignment with the lateral lugs 62.

Figure 4:
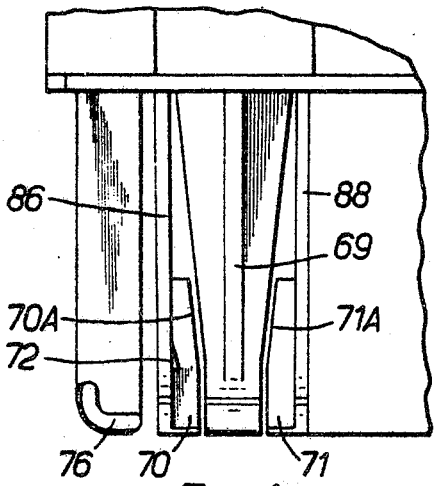
FIG. 4 is a plan view of a fixed portion of the suction cleaner, of the first embodiment which co-operates with the upper portion of the bag mount.
Figure 5:
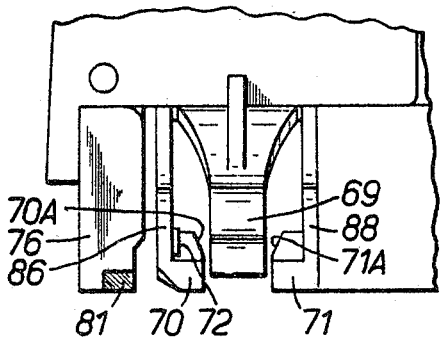
FIG. 5 is a front view of the fixed portion shown in FIG. 4.

Each of the vertical webs 66D and 66E has an upwardly facing arcuate surface 61D and 61E, and an inwardly facing vertical surface 63D and 63E, respectively. The arcuate surfaces 61D and 61E are struck about the horizontal pivotal axis of the fill tube 42, defined by the axis of engagement of the lip 12 with the ledge 13. In most positions of the fill tube, as shown in FIGS. 6, 7, 8 and 10, the arcuate surfaces are close to, or touching, corresponding arcuate surfaces on the bottom edges of parallel guides 86 and 88 extending downwards from an upper interior part of the casing 14. These guides are also seen in FIGS. 4 and 5. The inwardly facing vertical surfaces 63D and 63E are close to, or touch the outer vertical surfaces of the guides 86 and 88, respectively, when the fill tube is in the positions of FIGS. 6, 7, 8 and 10. These guides thus aid in guiding the fill tube during its backward and forward pivotal movements.

The bag securing means also comprise, in addition to the movable bag latching asssembly 60, a lower latch 80 (both may be considered latch portions) which is integral with, and immovable relatively to, the fill tube 42.

Beside the lower latch 80, and also integral with the fill tube 42, there is a laterally extending rib 23 (see FIG. 3) and an adjacent inverted L section formation 25. These are spaced apart to define a forwardly-facing inverted L section passage to receive the locating prong 24 on the door 20 when the latter is approaching its closed position, to ensure proper alignment of the fill tube 42 in relation to the door 20 carrying the bags 30, in the bag-transfer position.

Figure 3:
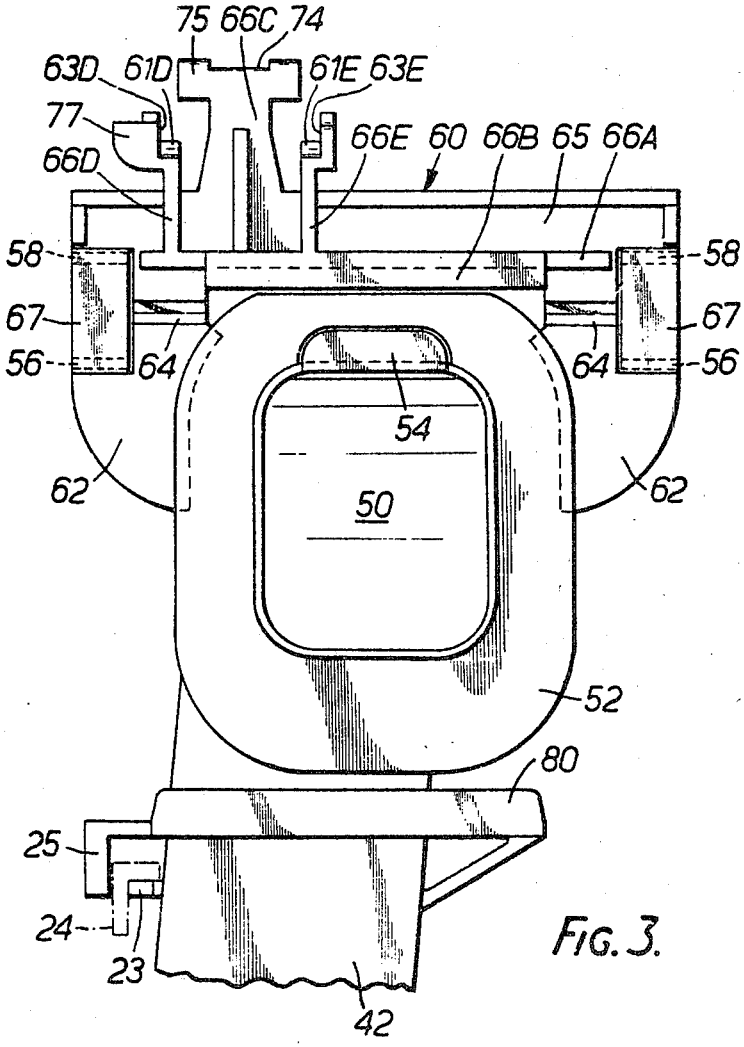
FIG. 3 is a front view of the upper portion of the bag mount of the preferred embodiment.

The upper end of the upstanding tab 66C of the movable latching assembly is approximately T shaped when viewed from the front, as in FIG. 3, the cross-piece of the T being just narrow enough to pass freely between the guides 86 and 88. At its forward end, each guide 86 and 88 has on its lower inner edge an inwardly facing ledge, 70 and 71, respectively. These ledges have inclined lead-in surfaces 70A and 71A, respectively. These serve to centralize the upstanding tab 66C as it approaches the forward end of the guides, e.g. as shown in FIG. 8. The guide 86 also has, above the ledge 70, a wedge-shaped detent 72. Between the guides 86 and 88 there is a forwardly projecting spring latch 69 having at its forward end a downwardly facing notch 68. Above the notch 68 the latch has a rearwardly facing vertical surface 73. In the center of the crosspiece of the upstanding tab 66C there is a lowered surface 74 adapted to be received in the notch 68 of the spring latch 69. On each side of the lowered surface 74 the ends of the crosspiece of the tab 66C extend rearwardly as lugs 75.

Figure 6:
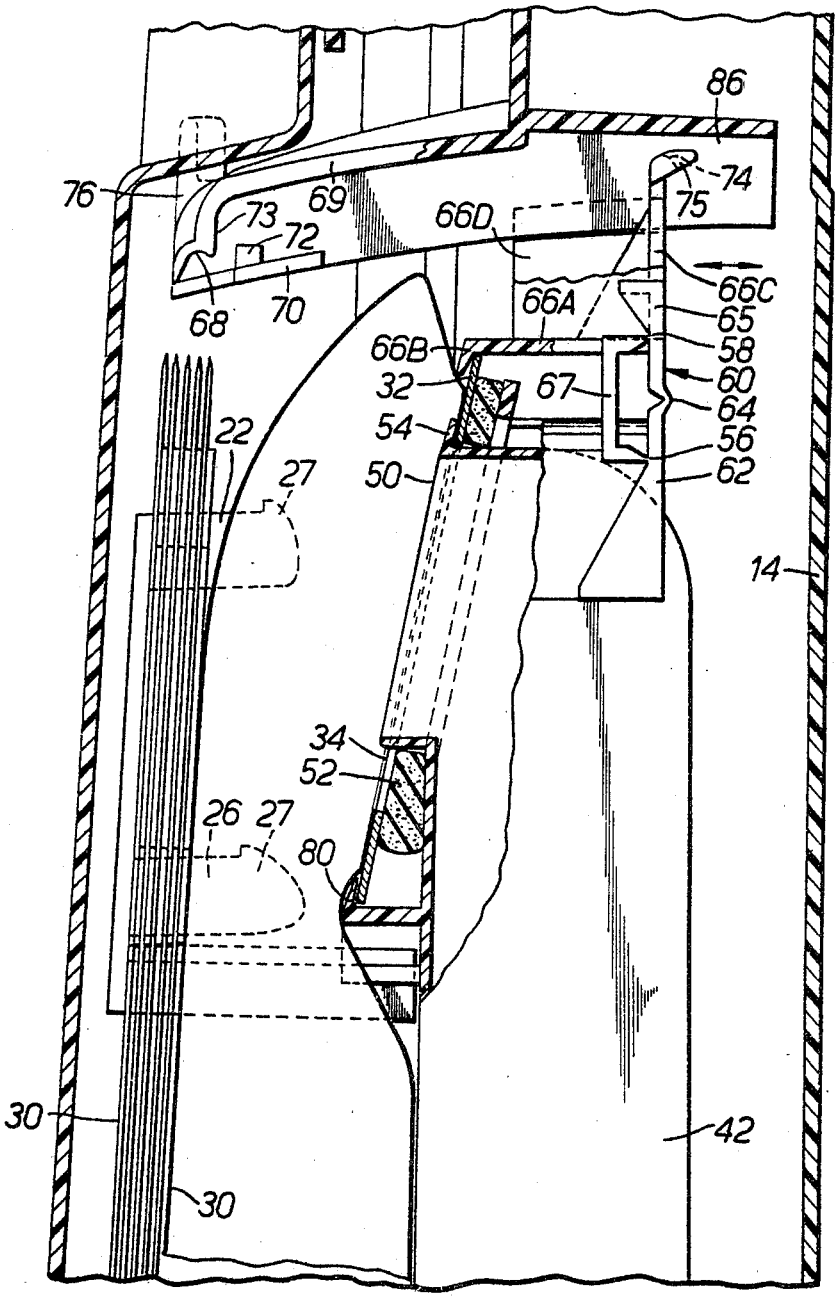
FIG. 6 is a sectional side elevation of part of the cleaner, of the first embodiment with its door closed and the bag mount in the operative region.
Figure 7:
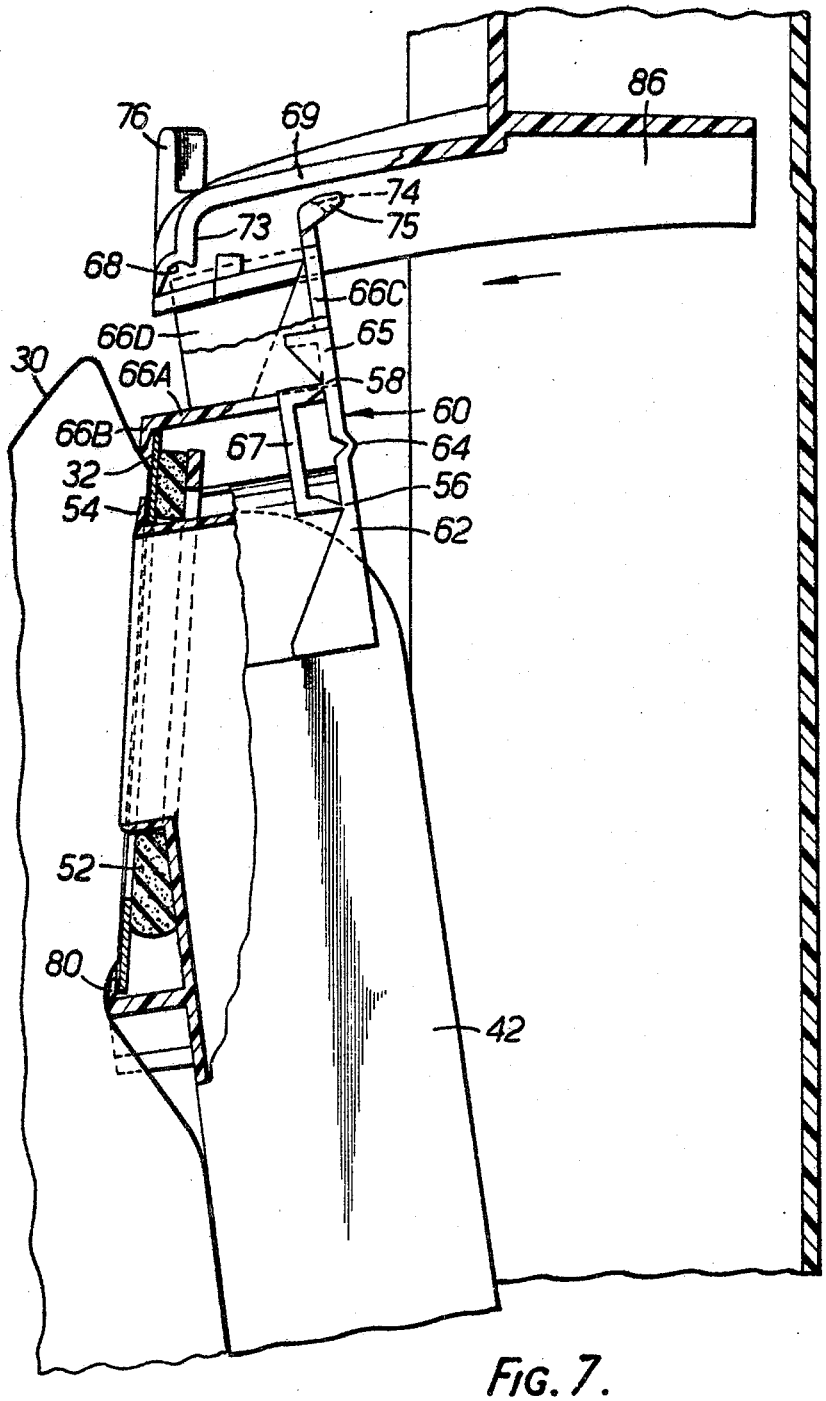
FIG. 7 is a sectional side elevation of the same part of the cleaner with the bag mount at the forward limit of the operative region.

Outside of the guide 86 there is a spring latch 76 which normally occupies the lower position shown in FIGS. 5, 6, 7 and 9, where it would obstruct forward movement of the fill tube 42 beyond the position shown in FIG. 7, the bottom of the latch 76 in this position lying across the path of a lateral lug 77 on the vertical web 66D of the movable latching assembly 60.

The automatic bag changing mechanism works as follows:

Assume that a bag 30 is already latched to the bag mount at the upper end of the fill tube 42, as shown in FIG. 6. The bag collar 32 is held with its bottom edge behind the fixed lower latch 80 and with its top edge behind the movable upper latch 66B, compressing the seal 52 and making a substantially airtight joint between the bag opening 34 and the fill tube outlet 50. Dirty air sucked into the cleaner through the suction nozzle 11 by the fan is blown up through the fill tube 42 and into the bag 30, where the dirt is filtered out, the clean air emerging through the bag walls and being returned to the room through apertures in the casing 14. The fill tube 42 can pivot freely back and forth throughout its operative region, between a rearmost position limited by the back wall of the casing 14, and a foremost position as shown in FIG. 7 where the lateral lug 77 on the vertical web 66D (FIG. 3) has come up against the bottom of the manually operable spring latch 76 (FIG. 5). This freedom of movement in the operative region permits the fill tube 42 to position itself to accommodate variations in the size of the bag 30 as it becomes increasingly full.

If the user wishes to inspect the bag, e.g. to see whether it is full enough to need changing, she can open the door 20. This draws the fill tube 42 and the bag 30 to the foremost limit of the operative region as shown in FIG. 7. The spring latch 76 prevents the fill tube and bag from moving beyond the FIG. 7 position. If the bag does not require changing, the user closes the door and the parts revert to the FIG. 6 condition.

If the bag is full, the user raises the spring latch 76 and opens the door further, to allow the lateral lug 77 to pass beneath the latch 76. The latch is then released and springs down behind the lateral lug, allowing the fill tube 42 to be drawn further forward as shown in FIG. 8. During this movement the upstanding tab 66C passes between the ledges 70, 71 of the guides 86 and 88 (FIGS. 4 and 5), ensuring that the tab 66C and hence the bag mount as a whole, are properly centered laterally. In the FIG. 8 position, the top of the tab 66C has made contact with the vertical surface 73 of the spring latch 69. The lug 75 on the side of the tab 66C nearest the guide 86 has passed above the wedge-shaped detent 72 on this guide. The bag collar 32 is still held between the lower fixed latch 80 and the upper movable latch 66B.

On opening the door further, the fill tube 42 continues to be drawn forward from the FIG. 8 position, but the top of the tab 66C cannot partake of this movement, being restrained by the vertical surface 73 of the spring latch 69. This further movement therefore causes the upper portions of the bag latch assembly 60, namely all the portions above the living hinges 64, to be tilted upwards relative to the portions below the hinges 64, as shown in FIG. 9. This raises the movable upper latch 66B well clear of the bag collar 32, allowing the seal 52 to expand and allowing the bag to be lifted clear of the fixed lower latch 80 and removed from the cleaner. This tilting movement of the upper portions of the latch assembly causes the tab 66C to slide down the vertical surface 73 until the lowered surface 74 of the tab enters the notch 68 of the spring latch 69. Also, the lug 77 of the tab which passed over the detent 72 is brought down to lie in front of the detent as shown.

For automatic replacement of the removed full bag by a new one from the magazine on the door, all the user has to do is to re-close the door. During the first part of the door reclosing movement the fill tube 42 is held against rearward movement because the lug 75 of the tab 66C is restrained against such rearward movement by the detent 72. What this part of the door reclosing movement does is to present the collar 32 of the rearmost bag in the magazine against the seal 52. The arrangement is such that the upper edge of the opening in the collar 32 just clears the hook 54 of the bag mount, and the bottom edge of the collar just clears the fixed lower latch 80. Because the door 20 and the fill tube 42 pivot about different horizontal axes, they move on different axes. When the collar 32 has engaged the seal 52 the arc of movement of the fill tube and hence of the seal is rising relative to the arc of movement of the door. At first this causes the hook 54 and the latch 80 to rise relative to the collar 32 and so entrap the collar. This entrapment, and the friction between the collar and the seal, will then cause the collar to follow the arc of movement of the fill tube 42 rather than that of the door. This has the effect of lifting the collar relatively to the door, particularly relative to the door tongues 22 and 26. This lifting movement is permitted by the partially open lower ends of the slots 36 and 40 in the collar, allowing the collar to be lifted over the hook-like tips 27 of the tongues while the bags still left in the magazine remain held by the tongues.

Figure 10:
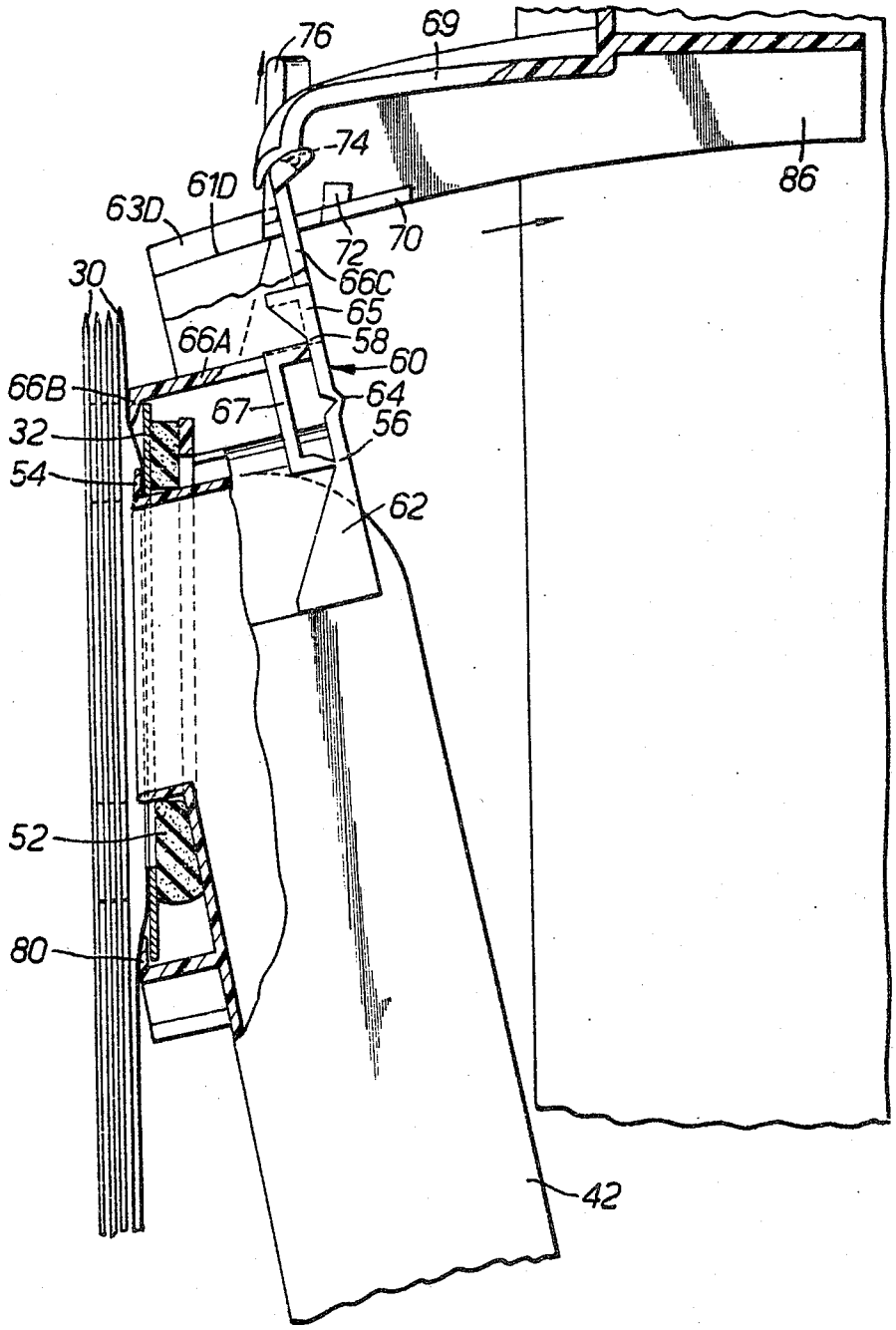
FIG. 10 is a sectional side elevation of the same part with a new bag just engaged by the bag mount.

A stronger closing force is then needed to close the door further. The effect of this is to straighten out the bag latching assembly about the hinges 64. This forces the tab 66C upwards, pressing it up against the spring latch 69. This latch is forced upwards as shown in FIG. 10, as the latching assembly is straightened. The straightening causes the upper parts of the assembly, above the hinges 64, to tilt downwards relative to the parts below the hinges 64 so that the upper latch 66B engages the top edge of the bag collar 32. The lugs 75 of the tab 66C are raised clear of the detent 72 which no longer resists rearward movement of the tab 66C. However, it is still restrained by its lowered surface 74 being engaged in the notch 68 of the spring latch 69.

A further push on the door 20 will force the lowered surface 74 of the tab 66C out of the notch 68, allowing the bag mount, to which the new bag is now latched in place, to move back into the operative region shown in FIGS. 6 and 7. As can be seen in FIG. 5, the righthand front lower corner 81 of the manually operable latch 76 is chamfered to form a lead-in which is engaged by the lateral lug 77 of the vertical web 66D as the bag mount is moved rearwards, so that the lug 77 itself lifts the latch 76 and passes beneath it.

In the second embodiment, primed numerals are utilized for parts common to both embodiments but differing in configuration. This embodiment includes a fairly conventional upright cleaner havinga lower casing 10' housing a motor fan unit which is arranged to drive an agitator situated at a forward suction nozzle 11'. The cleaner has a pair of forward wheels not shown and a pair of rear wheels 12.

Extending upwards from the rear of the casing 10' is a further upright generally rectangular casing 14' of a rigid nature and which is surmounted by a handle 16. The casing 14' is secured in its upright position of FIG. 11 by a latch, not shown, which can be released by a foot pedal 18A.

Figure 11:
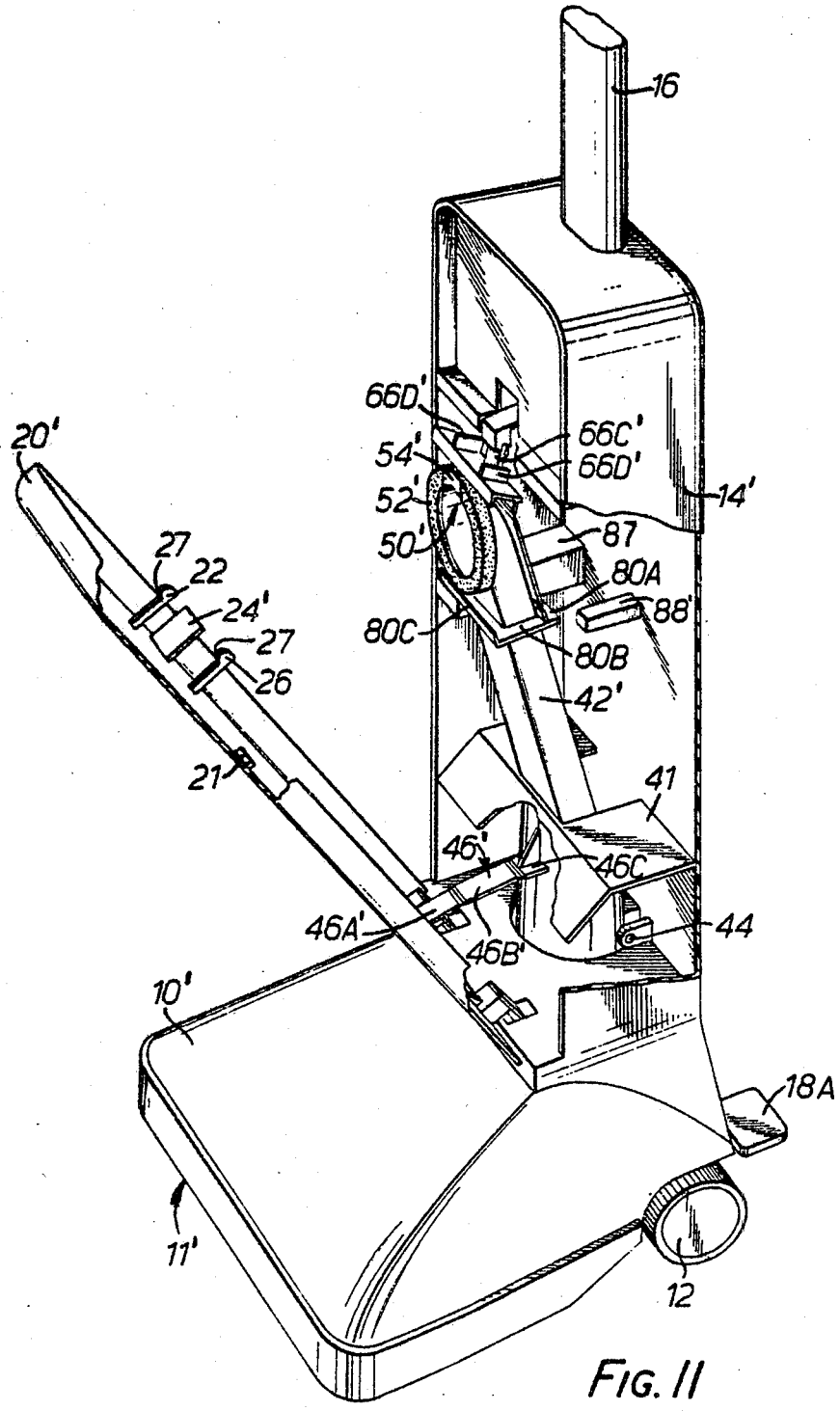
FIG. 11 is a perspective view of a second embodiment of an upright suction cleaner with a door in an open position and with certain parts broken away to illustrate the invention.
Figure 12:
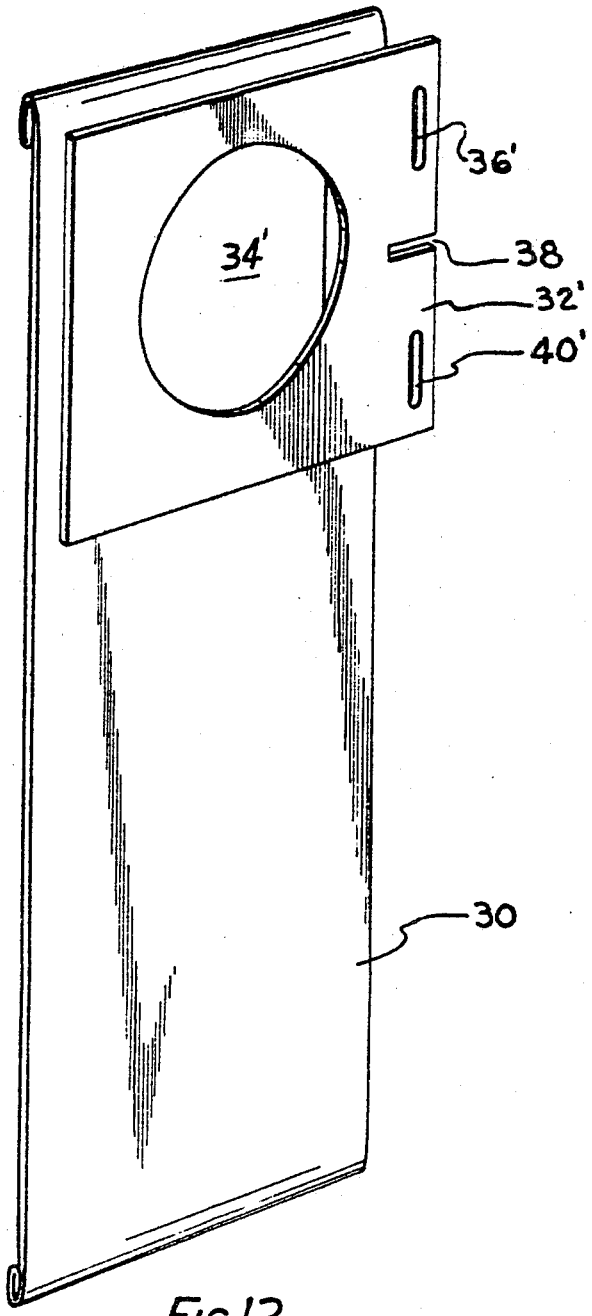
FIG. 12 is a perspective view of a paper bag with a cardboard collar secured thereto which is utilized in the cleaner of FIG. 11.

The casing 14' has a door 20' extending the full height of the front thereof and which is shown in a pivoted open position in FIG. 11. The door carries three tongues 22, 24' and 26 for mounting a series of five paper bags of the type shown in FIG. 12. Each bag comprises a folded and glued paper bag 30 made of conventional material which filters dirt from an air stream which passes through the porous wall of the bag. The bag has a cardboard mounting collar 32' provided with an oval opening 34'. The collar has slots 36', 38 and 40' to receive the tongues 22, 24' and 26 respectively. The tongues 22 and 26 each have a hook 27 whilst the tongue 24' is of a resilient nature to permit its free end to flex up and down. The door 20' thus acts as a magazine containing five bags with the cardboard collars 32' facing rearwards. In accordance with the present invention, closing of the door from the position of FIG. 11 automatically latches the rearmost bag collar onto a mechanism contained within the casing 14' in a manner to be described.

For this purpose the casing 14' has extending upwardly therein an exhaust air fill tube 42' of a rigid tubular nature connected at its lower end by a bellows, not shown, to an exhaust opening extending from the outlet of the motor fan unit. The fill tube 42' is arranged to pivot about a horizontal axis 44 at its lower end. Slightly above the pivot 44 the door 20' is interconnected with the front of the fill tube 42' by means of a strap 46' formed in three sections 46A', 46B' and 46C interconnected by living hinges.

Figure 13:
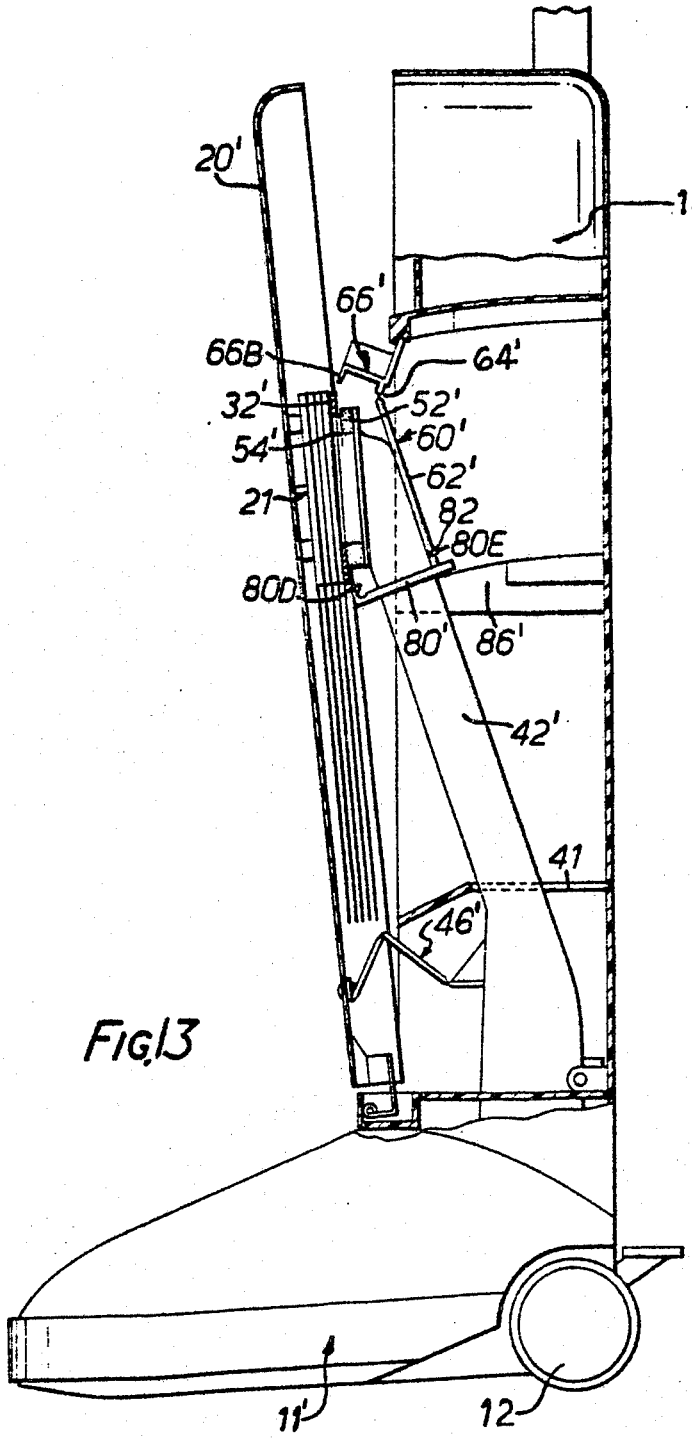
FIG. 13 is a sectional side elevation of the cleaner of FIG. 11 with its door partially closed.

The fill tube 42' extends upwards within the casing 14' and terminates in a forwardly extending circular outlet 50' which is surrounded by a circular seal 52' formed of foam plastics. Upstanding from the top forward edge of the circular opening 50' is an arcuate hook 54'. The hook 54' is not secured to the seal 52' so that, as will be described, the cardboard collar 32' of a bag can firstly be addressed up against the seal 52' as shown in FIG. 13 thereafter the seal can be compressed to the position shown in FIG. 14 at which time the collar 32' of the bag lies in a plane slightly behind the hook 54'. The bag and collar achieve this position during the closing movement of the door to the position of FIG. 14.

Figure 14:
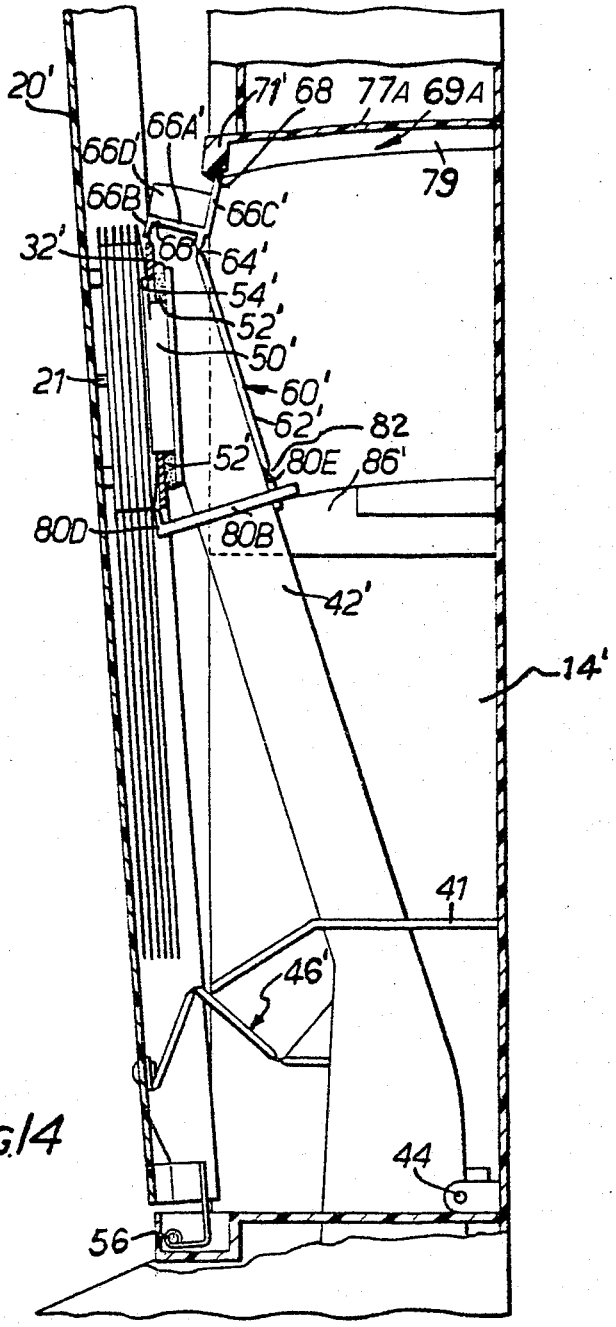
FIG. 14 is an enlarged sectional side elevation showing a stage of closure slightly beyond the position of FIG. 13.

Secured to or moulded integrally with the rear upper end of the fill tube 42' is a bag latching assembly generally indicated at 60' and which includes a plate 62' which is connected, via a living hinge 64', to an upper latch member 66' which includes a generally horizontal portion 66A' and a downwardly turned latch hook 66B together with a rear upstanding tab 66C'. The member 66' is completed by a pair of vertical webs 66D' shown most clearly in FIG. 11. In FIGS. 11 and 14 the upper end of the tab 66C is engaged in a downwardly facing notch 68 of a spring latch 71', which forms part of an inverted U shaped channel 69A which has an upper web 77A and a pair of side webs 79. The spring latch 71' has its rear end integral with the web 77A but its sides are separated from the side webs 79 to enable the spring latch 71' to move upwards and downwards, for example, to the position shown in FIG. 15.

The latching assembly 60', at its lower end, includes a lower latching member 80' which comprises a generally rectangular horizontally extending frame which, as shown in FIG. 11, includes a portion 80A lying to the rear of the fill tube 42', a pair of side portions 80B and an L-shaped forward portion 80C which includes an upstanding latch hook 80D, which, as will be described, is arranged to engage in front of the lower edge of the cardboard collar 32'. The latching member 80' is completed by an upstanding portion 80E which is connected via a living hinge 82 with the latching assembly 60'.

In order to guide the fill tube and the latch assembly 60' in an arcuate movement about the hinge 44 without twisting, a pair of cam members 86' and 88' extend forwardly from the rear wall of the casing 14 to engage the undersurfaces of the sides 80B of the latching member 80'. In a similar manner the upper end of the assembly is guided by means of the upper surfaces of the vertical webs 66D' which engage the under side of the U shaped channel 69A.

FIG. 11 shows the position of the door in its most open condition at which time the magazine of bags carried by the door 20' will be well clear of the seal 52' at the top of the fill tube 42'. In FIG. 11 the fill tube is limited in its forward movement by a plate 41. FIG. 13 illustrates the door in a partially closed position at which the rearmost bag has its cardboard collar 32' about to touch the seal 52'. FIG. 14 illustrates a slightly more rearward position of the door 20' when the pressure of the user closing the door causes a web 21 on the door to compress the bags on the door so that the collar 32' of the rear bag compresses the seal 52', at which stage the collar 32' lies in a plane behind the hook 54' as has been described.

Figure 15:
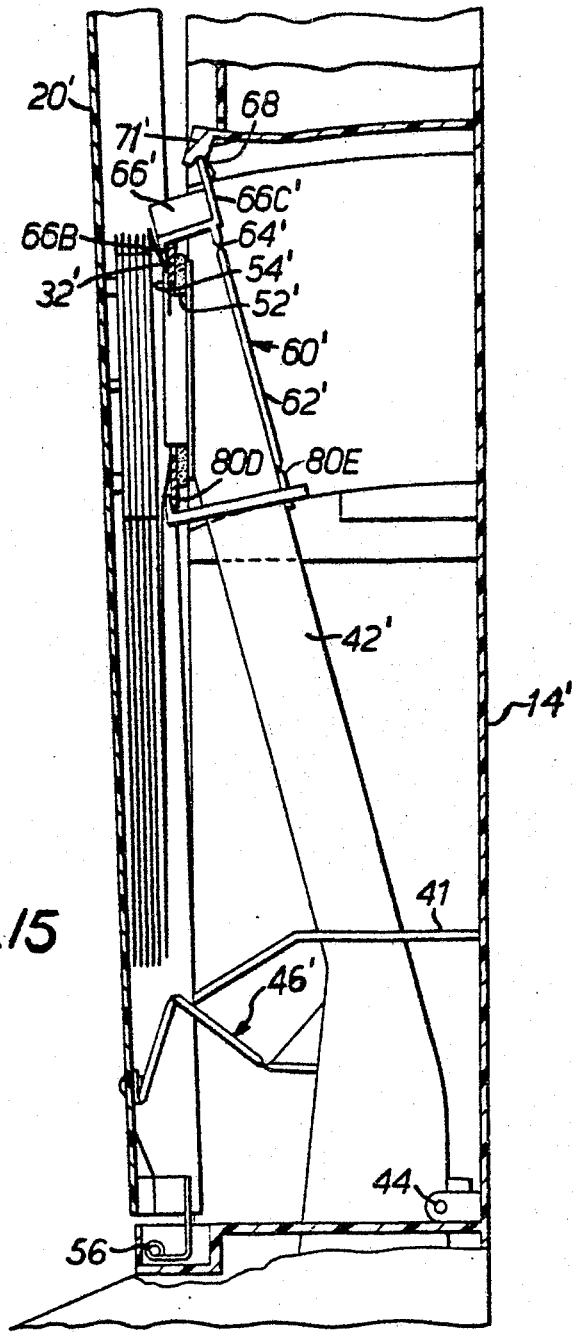
FIG. 15 is a sectional side elevation of the second embodiment showing the bag collar partially engaged by a pair of latches.
Figure 17:
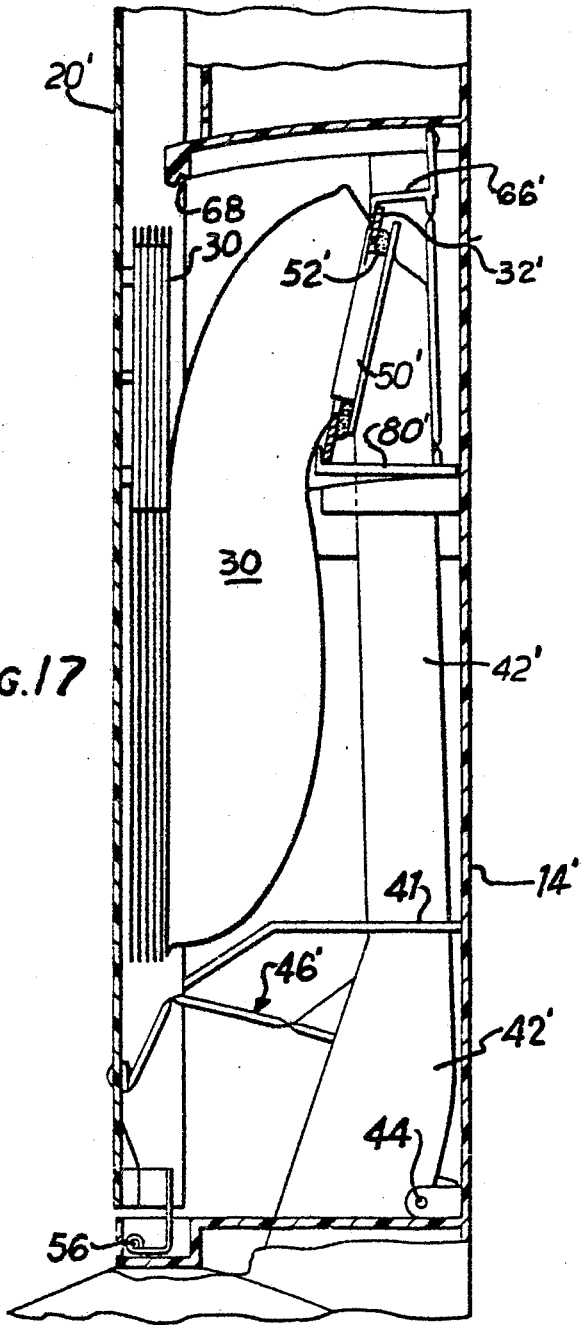
FIG. 17 illustrates the second embodiment bag fully expanded.

Further closing movement of the door 20' causes the fill tube 42' to pivot rearwardly about its lower hinge 44 from the position of FIG. 14 to the position of FIG. 15. In this latter position it will be appreciated that the living hinge 64' has moved arcuately, rearwardly, and upwardly to cause the rear upstanding tab 66C' to bias the spring latch 71' upwards to the position shown in FIG. 15. In fact in FIG. 15 it will be seen that the parts 62', 66C' and 80E are in what may be termed a stressed dead-center position in which they are all in line. Achieving the position of FIG. 17 has caused the latch member 66' to rotate anticlockwise until its downwardly turned latch hook 66B engages over the forward edge of the bag collar 32' between the collar and the remainder of the paper bag. Similarly the lower upstanding latch hook 80D is rotated clockwise to engage behind the lower rear edge of the bag collar 32'. The anticlockwise rotary movement of the upper latch member 66' forces the bag collar 32' downwards between the seal 52' and the upstanding arcuate hook 54'.

Figure 16:
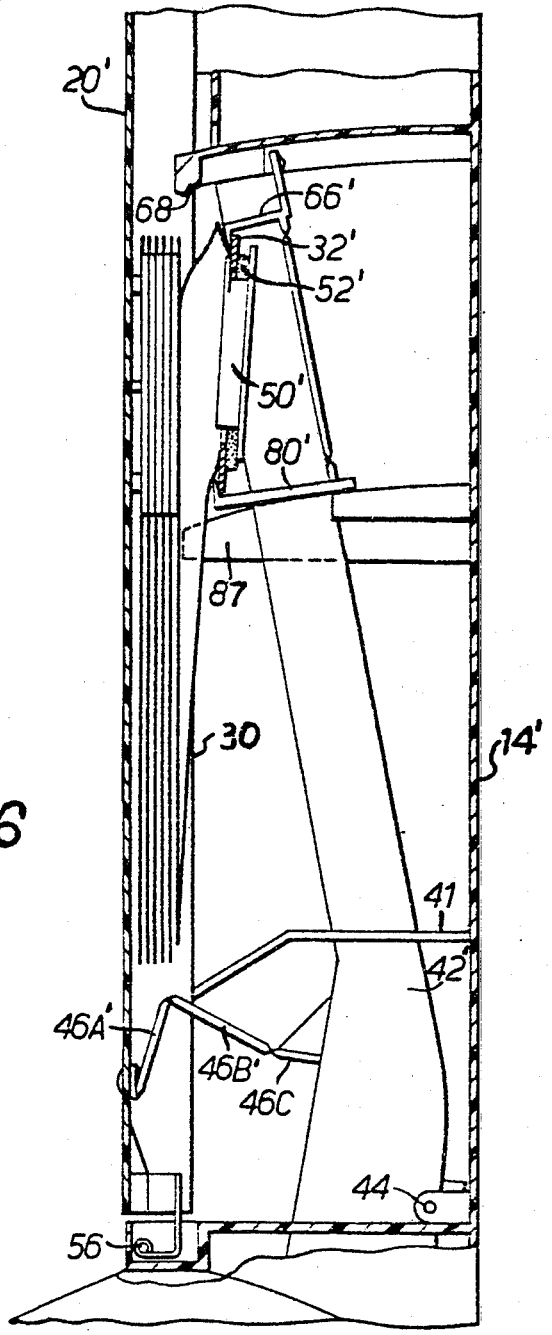
FIG. 16 illustrates the second embodiment arrangement with the door fully closed and the paper bag, engaged by the latches, beginning to expand.
Figure 18:
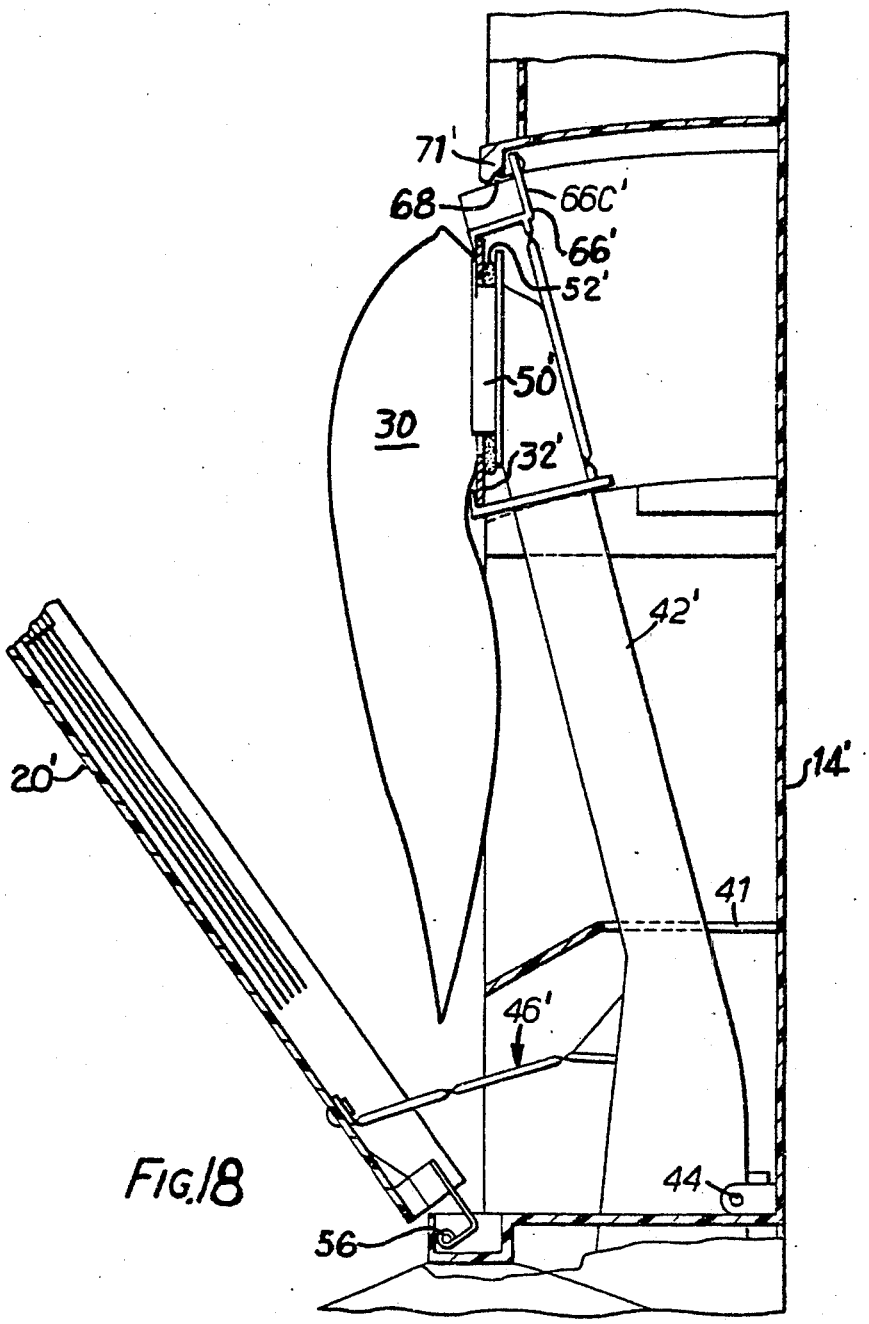
FIG. 18 shows the second embodiment door open and the bag drawn forward towards a removal position but still engaged by the latches.
Figure 19:
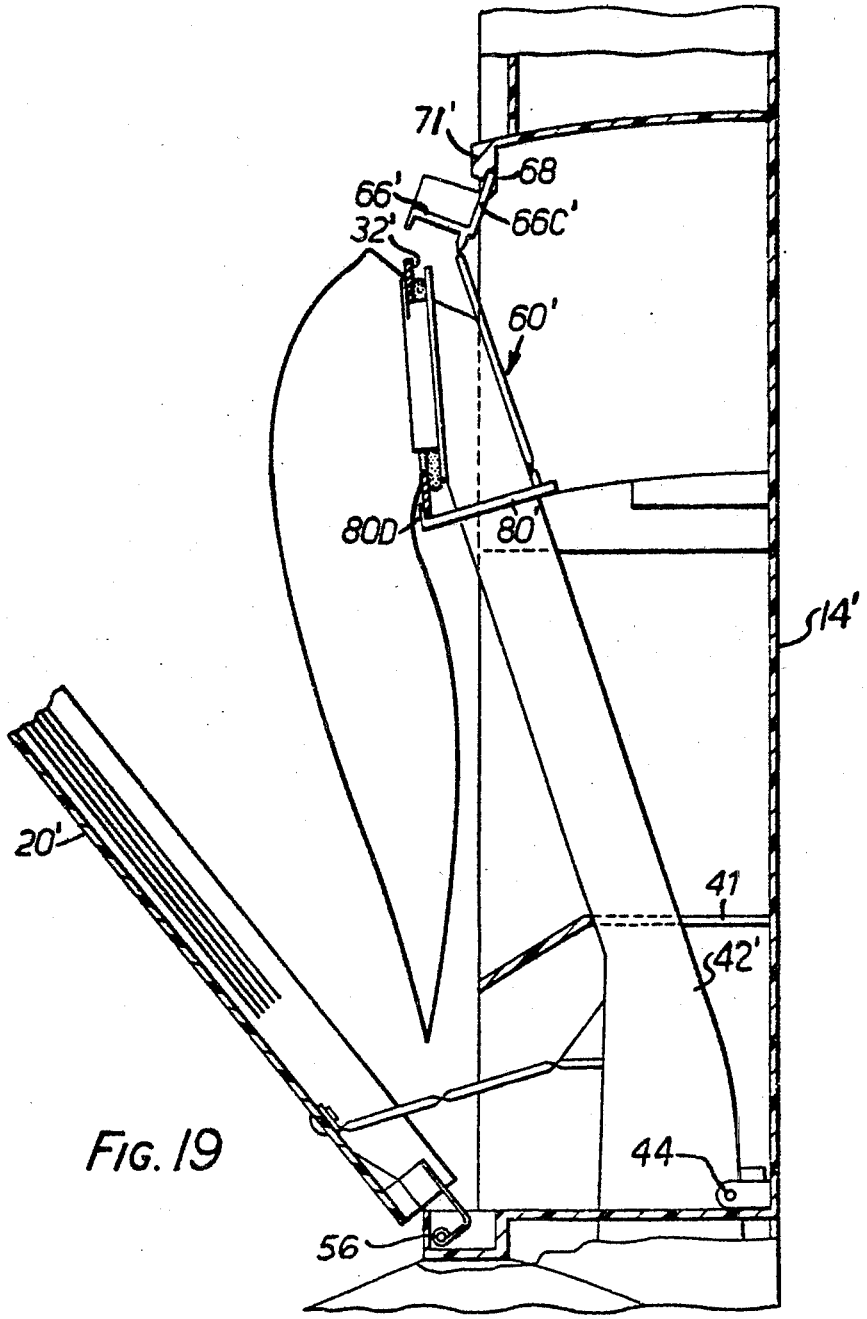
FIG. 19 illustrates a stage slightly beyond FIG. 18 in which the bag is ready to be removed by hand from the cleaner. The preferred embodiment of the invention shown in FIGS. 1–10 of the drawings is applied to a fairly conventional upright cleaner having a lower casing 10 housing a motor fan unit or suction means which is arranged to drive an agitator situated at a forward suction nozzle 11. The lower casing 10 is mounted on a pair of forward wheels and a pair rear wheels which are not visible in the drawings.

Full closing of the door about its pivot 56 to the position of FIG. 16 causes the latch assembly 60' to be forced beyond its dead center position and rearwardly so that the upper end of the rear upstanding tab 66C' clears the notch 68 to allow free rearward movement of the fill tube 42' about its axis 44. The lower latch member 80' is then guided by the cam 87 so that it rotates slightly further clockwise, as the upper latch member 66' rotates slightly further anticlockwise, fully to engage behind the lower and upper edges of the bag collar 32' respectively. It is to be noted to FIG. 15 however that the bag collar 32', engaging the seal 52' has in fact moved to a slightly higher position in relation to the other bags in the magazine. This is possible due to flexing of the tongue 24' (FIG. 11), which at the same time disengages the bag collar 32' from the hooks 27 of the tongues 22 and 26. The positive action of the latch members 66' and 80' also ensures that the bag collar keeps the seal 52' compressed to maintain a good seal between the fill tube 42' and the paper bag proper. As soon as the cleaner is operated, dirt-laden air will exhaust up the fill tube 42' and into the bag via the circular opening50', so commencing inflation of the bag–see FIG. 18. Inflation of the bag causes further rearward movement of the fill tube 42' to the maximum rearward position shown in FIG. 17. Alternatively, momentum of the fill tube may take it to the operative position. Normal operation of the cleaner can now continue until the time is appropriate to remove and dispose of the bag being used in the cleaner. This is achieved simply by opening the door 20'. This causes the fill tube 42' to be pivoted anticlockwise to the position of FIG. 18 by virtue of the strap 46' which acts as a tension link as shown in FIG. 18. This draws the upper end of the fill tube forwardly to the position of FIG. 18 at which time the rear upstanding tab 66C' hits the rear of the latch 71'. The slight further movement of the door to its fully open position of FIG. 19 causes the rear upstanding tab 66C' to be engaged in the notch 68 of the spring latch 71, so causing the upper latching member 66' to rotate clockwise to the position shown in FIG. 19 which clears it from the upper edge of the bag collar 32'. It is to be particularly noted at this time that the lower latch 80' remains in position engaging the lower edge of the bag collar 32'. For this purpose the latch hook 80D of the latch member 80' is provided with a rear face at its point of engagement with the collar 32' which causes a force to be applied to the collar 32' rearwardly to retain the latch member 80' engaged with the collar 32' although it is in fact free at that time to drop back to the position of FIG. 13 as soon as the bag is removed. The bag is so removed simply by the operator lifting it out of the cleaner from the FIG. 19 position. The door is then closed again and the same cycle occurs in order to secure the next bag from the magazine to the latching assembly 60'.

By these ways, therefore, the user of the cleaner only has periodically to load a magazine of five bags into the door and close the door of the cleaner in order to install the first bag in the cleaner. When requiring changing, the bags are removed in the manner indicated and the fresh bags installed simply by reclosing the door. The operator has no intricate assembly work to carry out and can keep his or her hands perfectly clean during the replacement operation. If in checking a bag after removal, the user finds that in fact it need not be replaced yet, the bag can be simply reinserted manually by direct engagement with the latching means rather than placing back on the tongues on the door.

What is claimed is:

1. A suction cleaner including a suction means, a dirt collecting bag disposed in a dirt collecting bag receiving cavity, a bag carrier and a bag mount movable relatively towards one another, a securing means for automatically securing said dirt collecting bag on the bag mount upon relative movement between said bag carrier and said bag mount, said dirt collecting bag, when secured, having an opening in sealing engagement with an air conduit, said air conduit forming said bag mount, said bag carrier and said bag mount being relatively separable after securement to permit said dirt collecting bag to expand between said bag carrier and said bag mount, said bag carrier acting as a magazine to receive a plurality of fresh dirt collecting bags, at least one fresh bag being disposed in said magazine, a casing forming said cavity, said air conduit being in communication with said suction means and said casing such that said bag mount is disposed in said cavity, said bag carrier being disposed on said casing so as to be in communication with said cavity, said bag carrier being movable between an open position with respect to said casing to permit withdrawal of said dirt collecting bag when full and a bag transfer position with said fresh dirt collecting bag being disposed closely adjacent said bag mount, said bag mount being movable between a bag unloading position and an operative position in which the fresh bag is in sealing engagement with said conduit and is carried by the bag mount away from the bag carrier.

2. A suction cleaner as claimed in claim 1 wherein said bag mount is movable from said operative position to the bag unloading position by movement of the bag carrier.

3. A suction cleaner as claimed in claim 1 wherein the securing means comprises latch members on said bag mount which engage opposite sides of a bag collar provided on said bag when said bag mount is in said operative position.

4. A suction cleaner as claimed in claim 3 wherein at least one of said latch members is biased to a latching position by a stationary cam on said casing against which the said latch member engages during movement of the bag mount towards its operative position.

5. A suction cleaner as claimed in claim 3 wherein one of said latch members is released automatically on movement of the bag mount to the unloading position, whilst the other latch members remains engaged with the bag collar.

6. A suction cleaner as claimed in claim 3 wherein said bag collar has at least a pair of vertically extending slots, said slots being partly closed by hook portions on said collar.

7. A suction cleaner as claimed in claim 3 wherein said bag collar has at least a pair of vertically extending slots, said slots being disposed inboard of the border of said bag collar.

8. A suction cleaner having a suction means and a casing forming a dirt bag receiving compartment, a bag carrier formed on said casing and a bag mount disposed within said compartment at least one dirt collecting bag being disposed on each of said bag carrier and said bag mount, said bag carrier acting as a magazine for the storage of at least one fresh bag, the bag on said carrier constituting said fresh bag, said bag carrier and said bag mount being relatively movable towards one another to automatically cause securing means for securing said fresh bag on said bag mount when said bag on said bag mount is full and has been removed with an opening of said fresh bag in sealing engagement with an air conduit, said air conduit forming said bag mount and being in communication with said suction means and said casing, said bag mount being movable between a bag unloading position relatively away from said casing to permit removal of said full bag and an operative position in which said fresh bag is carried by the bag mount away from said bag carrier.

* * * * *